US012349727B2

(12) United States Patent
Lee et al.

(10) Patent No.: US 12,349,727 B2
(45) Date of Patent: Jul. 8, 2025

(54) AEROSOL DISPENSING DEVICE WITH DISPOSABLE CONTAINER

(71) Applicant: JUUL Labs, Inc., San Francisco, CA (US)

(72) Inventors: Namhey Lee, Hayward, CA (US); Jia Li, Burlingame, CA (US); Maurizio Tarsia, San Carlos, CA (US)

(73) Assignee: JUUL Labs, Inc., Washington, DC (US)

( * ) Notice: Subject to any disclaimer, the term of this patent is extended or adjusted under 35 U.S.C. 154(b) by 419 days.

(21) Appl. No.: 17/880,531

(22) Filed: Aug. 3, 2022

(65) Prior Publication Data

US 2022/0369706 A1 Nov. 24, 2022

Related U.S. Application Data

(63) Continuation of application No. PCT/US2021/016568, filed on Feb. 4, 2021.
(Continued)

(51) Int. Cl.
*A24F 40/40* (2020.01)
*A24F 40/10* (2020.01)
*A24F 40/51* (2020.01)

(52) U.S. Cl.
CPC ..... *A24F 40/40* (2020.01); *A24F 40/10* (2020.01); *A24F 40/51* (2020.01)

(58) Field of Classification Search
None
See application file for complete search history.

(56) References Cited

U.S. PATENT DOCUMENTS 4,068,687 A 1/1978 Long
4,708,151 A 11/1987 Shelar
(Continued)

FOREIGN PATENT DOCUMENTS

AU 2013205041 A1 5/2013
AU 2012202592 B2 7/2015
(Continued)

OTHER PUBLICATIONS

Liu et al.WO_2019100228_A1_I English Machine Translation (Year: 2019).*
(Continued)

*Primary Examiner* — Michael H. Wilson
*Assistant Examiner* — Daniel Edward Vakili
(74) *Attorney, Agent, or Firm* — Mintz, Levin, Cohn, Ferris, Glovsky, and Popeo, P.C.

(57) ABSTRACT

A vaporizer device includes a cartridge and a vaporizer body. The cartridge includes reservoir configured to hold a vaporizable material. The cartridge further includes a channel extending from the reservoir and having an opening at an end of the channel. The vaporizer body includes a movable block. The vaporizer body further includes a controller configured to actuate the movable block, the actuating of the movable block moving the movable block towards the channel to compress the channel, and the compression of the channel ejects, from the opening, at least a portion of the vaporizable material. The vaporizer body further includes a heating element positioned toward the opening of the channel when the cartridge is coupled with the vaporizer body, the heating element configured to vaporize the portion of the vaporizable material.

21 Claims, 7 Drawing Sheets

Related U.S. Application Data

(60) Provisional application No. 62/970,140, filed on Feb. 4, 2020.

(56) References Cited

U.S. PATENT DOCUMENTS 4,945,929 A 8/1990 Egilmex
5,175,791 A 12/1992 Muderlak et al.
5,240,012 A 8/1993 Ehrman et al.
5,573,692 A * 11/1996 Das ..... A24F 40/70 131/273
5,610,635 A 3/1997 Murray et al.
5,842,601 A 12/1998 Pierpoint
6,053,176 A 4/2000 Adams et al.
6,084,616 A 7/2000 Nakata et al.
6,196,218 B1 3/2001 Voges
6,516,796 B1 2/2003 Cox et al.
6,637,430 B1 10/2003 Voges et al.
6,708,846 B1 3/2004 Fuchs et al.
6,854,461 B2 2/2005 Nichols et al.
7,147,170 B2 12/2006 Nguyen et al.
7,500,479 B2 3/2009 Nichols et al.
7,581,540 B2 9/2009 Hale et al.
7,766,013 B2 8/2010 Wensley et al.
7,913,686 B2 3/2011 Hughes et al.
8,434,478 B2 5/2013 Yamada et al.
8,689,789 B2 4/2014 Andrus et al.
8,794,245 B1 8/2014 Scatterday
8,915,254 B2 12/2014 Monsees et al.
8,975,764 B1 3/2015 Abehasera
8,991,402 B2 3/2015 Bowen et al.
9,078,475 B2 7/2015 Li et al.
9,247,773 B2 2/2016 Memari et al.
9,271,526 B2 3/2016 Liu
9,295,286 B2 3/2016 Shin
9,302,800 B2 4/2016 Holmes et al.
9,498,002 B1 11/2016 Wu
9,549,573 B2 1/2017 Monsees et al.
9,603,389 B2 3/2017 Chen
9,675,116 B2 6/2017 Liu
9,687,027 B2 6/2017 Poston et al.
9,808,071 B2 11/2017 Thiebaut et al.
10,034,988 B2 7/2018 Wensley et al.
10,039,318 B2 8/2018 Daryani
10,045,567 B2 8/2018 Monsees et al.
10,058,129 B2 8/2018 Monsees et al.
10,058,130 B2 8/2018 Monsees et al.
10,076,139 B2 9/2018 Monsees et al.
10,104,913 B2 10/2018 Lau et al.
10,104,915 B2 10/2018 Bowen et al.
10,111,470 B2 10/2018 Monsees et al.
10,130,123 B2 11/2018 Hatton et al.
10,143,239 B2 12/2018 Gavrielov et al.
10,244,793 B2 4/2019 Monsees et al.
10,278,421 B2 5/2019 Lord
10,285,450 B2 5/2019 Gavrielov et al.
10,314,343 B2 6/2019 Newcomb et al.
10,420,374 B2 9/2019 Liu
10,470,491 B2 11/2019 Sutton et al.
10,588,356 B2 3/2020 Harrison et al.
10,676,228 B2 6/2020 Cadieux et al.
10,701,981 B2 7/2020 Newcomb et al.
10,709,173 B2 7/2020 Monsees et al.
10,792,685 B2 10/2020 Tong
10,834,969 B2 11/2020 Godfrey et al.
10,858,137 B2 12/2020 Garthaffner
10,912,333 B2 2/2021 Atkins et al.
10,925,317 B2 2/2021 Smith et al.
11,019,685 B2 5/2021 Bowen et al.
11,160,936 B2 11/2021 Bache et al.
11,160,939 B2 11/2021 Sears et al.
11,213,638 B2 1/2022 Nettenstrom et al.
11,253,001 B2 2/2022 Atkins et al.
11,478,021 B2 10/2022 Bowen et al.
11,647,783 B2 5/2023 Bowen et al.
11,801,351 B2 10/2023 Bucknor, Jr. et al.
2002/0071664 A1 6/2002 Aronie et al.
2003/0005926 A1 1/2003 Jones et al.
2003/0215335 A1 11/2003 Crivelli
2004/0021017 A1 2/2004 Sumiyoshi et al.
2005/0016550 A1 1/2005 Katase
2005/0022806 A1 2/2005 Beaumont et al.
2005/0066961 A1 3/2005 Rand
2009/0192443 A1 7/2009 Collins, Jr.
2010/0006092 A1 1/2010 Hale et al.
2010/0199257 A1 8/2010 Biggerstaff
2012/0174914 A1 7/2012 Pirshafiey et al.
2012/0199146 A1 8/2012 Marangos
2013/0078025 A1 3/2013 Turgeman et al.
2013/0298905 A1* 11/2013 Levin ..... A24F 40/90 128/202.21
2013/0327327 A1 12/2013 Edwards et al.
2014/0053952 A1 2/2014 Genosar
2014/0175081 A1 6/2014 Hwa
2014/0261493 A1 9/2014 Smith et al.
2014/0276536 A1 9/2014 Estes
2014/0346689 A1* 11/2014 Dubief ..... B01F 23/21 261/142
2014/0373857 A1 12/2014 Steinberg
2015/0101945 A1 4/2015 Scatterday
2015/0164138 A1 6/2015 Liu
2015/0216237 A1* 8/2015 Wensley ..... A24F 40/48 131/273
2015/0257447 A1 9/2015 Sullivan
2015/0257451 A1 9/2015 Brannon et al.
2015/0289565 A1 10/2015 Cadieux et al.
2015/0327597 A1 11/2015 Li et al.
2016/0007653 A1 1/2016 Tu
2016/0058071 A1 3/2016 Hearn
2016/0091194 A1 3/2016 Liu
2016/0120226 A1 5/2016 Rado
2016/0167846 A1 6/2016 Zahr et al.
2016/0183595 A1 6/2016 Grimandi et al.
2016/0183596 A1 6/2016 Rado
2016/0237748 A1* 8/2016 Jones ..... E21B 7/062
2016/0262459 A1 9/2016 Monsees et al.
2016/0345628 A1 12/2016 Sabet
2016/0366943 A1 12/2016 Li et al.
2017/0006915 A1 1/2017 Li et al.
2017/0027228 A1 2/2017 Rastogi
2017/0042225 A1 2/2017 Huizhou
2017/0055580 A1 3/2017 Blandino et al.
2017/0079324 A1 3/2017 Eksouzian
2017/0079328 A1 3/2017 Shenzhen
2017/0086506 A1 3/2017 Rado
2017/0095004 A1 4/2017 Liu
2017/0136196 A1 5/2017 Davidson et al.
2017/0146005 A1 5/2017 Edelen
2017/0158436 A1 6/2017 Slurink
2017/0196264 A1 7/2017 Liu
2017/0290369 A1 10/2017 Norasak
2017/0303588 A1* 10/2017 Batista ..... H05B 3/26
2017/0304563 A1 10/2017 Adelson
2017/0304567 A1 10/2017 Adelson
2017/0325503 A1 11/2017 Liu
2017/0368273 A1 12/2017 Rubin
2018/0016040 A1 1/2018 Ewing et al.
2018/0042305 A1 2/2018 Hogwood et al.
2018/0066645 A1 3/2018 Mazur
2018/0154092 A1 6/2018 Patoret
2018/0170588 A1 6/2018 Boldrini
2018/0184722 A1* 7/2018 Murison ..... F04B 43/14
2018/0303162 A1 10/2018 Zhang et al.
2018/0364745 A1 12/2018 Chamot
2019/0069601 A1 3/2019 Qiu
2019/0099562 A1 4/2019 Nettenstrom et al.
2019/0104767 A1 4/2019 Hatton et al.
2019/0166913 A1 6/2019 Trzecieski
2019/0167923 A1 6/2019 Kessler et al.
2019/0246693 A1 8/2019 Nettenstrom et al.
2019/0307170 A1 10/2019 Zarifian et al.
2020/0128874 A1 4/2020 Atkins et al.
2020/0187560 A1 6/2020 Trzecieski
2020/0221778 A1 7/2020 Trzecieski

(56) References Cited

U.S. PATENT DOCUMENTS

| | | | | |
|---|---|---|---|---|
| 2020/0260788 | A1* | 8/2020 | Cornils | A24F 40/10 |
| 2021/0145051 | A1 | 5/2021 | Florack et al. | |
| 2021/0329976 | A1 | 10/2021 | Nelson et al. | |
| 2022/0040725 | A1* | 2/2022 | Fliess | B05C 5/001 |
| 2022/0295877 | A1* | 9/2022 | Beard | A24F 40/50 |

FOREIGN PATENT DOCUMENTS

| | | | | |
|---|---|---|---|---|
| CA | 3039746 | A1 * | 6/2018 | A24F 40/10 |
| CN | 101443066 | B | 12/2012 | |
| CN | 101600469 | B | 10/2013 | |
| CN | 203341007 | U | 12/2013 | |
| CN | 203341008 | U | 12/2013 | |
| CN | 102264420 | B | 3/2014 | |
| CN | 105192895 | B | 7/2018 | |
| CN | 110226778 | A | 9/2019 | |
| CN | 209527874 | U | 10/2019 | |
| CN | 209807156 | U | 12/2019 | |
| DE | 102017123869 | B4 | 5/2019 | |
| DE | 102019109079 | B4 | 6/2020 | |
| DE | 202020105847 | U1 | 10/2020 | |
| DE | 202020106442 | U1 | 11/2020 | |
| DE | 202018006603 | U1 | 6/2021 | |
| DE | 202020005553 | U1 | 8/2021 | |
| EP | 2741625 | B1 | 4/2017 | |
| EP | 2719416 | B1 | 6/2017 | |
| EP | 2961288 | B1 | 10/2018 | |
| EP | 3143882 | B1 | 11/2018 | |
| EP | 2925395 | B1 | 3/2019 | |
| EP | 3387924 | B1 | 9/2019 | |
| EP | 1539284 | B1 | 1/2020 | |
| EP | 3096636 | B1 | 4/2020 | |
| EP | 3145350 | B1 | 9/2020 | |
| EP | 3387927 | B1 | 9/2020 | |
| EP | 3481473 | B1 | 9/2020 | |
| EP | 3143884 | B1 | 1/2021 | |
| EP | 3437495 | B1 | 2/2021 | |
| EP | 3590368 | B1 | 4/2021 | |
| EP | 3630660 | B1 | 6/2021 | |
| EP | 3653066 | B1 | 6/2021 | |
| EP | 3556233 | B1 | 8/2021 | |
| EP | 3593656 | B1 | 10/2021 | |
| EP | 3522960 | B1 | 12/2021 | |
| EP | 3525854 | B1 | 12/2021 | |
| EP | 3677135 | B1 | 1/2022 | |
| EP | 3813577 | B1 | 2/2022 | |
| EP | 3146856 | B1 | 3/2022 | |
| EP | 3656230 | B1 | 5/2022 | |
| EP | 3656232 | B1 | 5/2022 | |
| EP | 3793745 | B1 | 7/2022 | |
| EP | 3793746 | B1 | 7/2022 | |
| EP | 3793747 | B1 | 7/2022 | |
| EP | 3731665 | B1 | 8/2022 | |
| EP | 3616536 | B1 | 9/2022 | |
| EP | 3793744 | B1 | 9/2022 | |
| EP | 3513670 | B1 | 11/2022 | |
| EP | 3801077 | B1 | 11/2022 | |
| EP | 3883629 | B1 | 11/2022 | |
| EP | 3817606 | B1 | 12/2022 | |
| EP | 3813564 | B1 | 1/2023 | |
| EP | 3836813 | B1 | 1/2023 | |
| EP | 3741227 | B1 | 2/2023 | |
| EP | 3890523 | B1 | 2/2023 | |
| EP | 3691405 | B1 | 4/2023 | |
| EP | 3874979 | B1 | 4/2023 | |
| EP | 3849354 | B1 | 6/2023 | |
| EP | 3986184 | B1 | 6/2023 | |
| GB | 2586301 | B | 8/2021 | |
| JP | 5434000 | B2 | 3/2014 | |
| JP | 2017127649 | A | 7/2017 | |
| KR | 20-0462610 | Y1 | 9/2012 | |
| KR | 10-2012-0132070 | A | 12/2012 | |
| KR | 10-2015-0046318 | A | 4/2015 | |
| KR | 10-2015-0064754 | A | 6/2015 | |
| KR | 10-1554435 | B1 | 9/2015 | |
| KR | 10-1600646 | B1 | 3/2016 | |
| KR | 10-2018-0028493 | A | 3/2018 | |
| KR | 10-1900275 | B1 | 9/2018 | |
| KR | 10-2019-0107017 | A | 9/2019 | |
| KR | 10-2027782 | B1 | 10/2019 | |
| KR | 10-2027791 | B1 | 10/2019 | |
| KR | 10-2021-0127579 | A | 10/2021 | |
| KR | 10-2022-0093142 | A | 7/2022 | |
| RU | 2008123175 | A | 12/2009 | |
| TW | 201929699 | A | 8/2019 | |
| WO | WO-9501137 | A1 | 1/1995 | |
| WO | WO-2021127227 | A1 | 1/1995 | |
| WO | WO-9639879 | A1 | 12/1996 | |
| WO | WO-2005025654 | A1 | 3/2005 | |
| WO | WO-2010095391 | A1 | 8/2010 | |
| WO | WO-2012026963 | A2 | 3/2012 | |
| WO | WO-2012129812 | A1 | 10/2012 | |
| WO | WO-2013012157 | A1 | 1/2013 | |
| WO | WO-2014067236 | A1 | 5/2014 | |
| WO | WO-2015013926 | A1 | 2/2015 | |
| WO | WO-2015027436 | A1 | 3/2015 | |
| WO | WO-2015058387 | A1 | 4/2015 | |
| WO | WO-2015120589 | A1 | 8/2015 | |
| WO | WO-2015150699 | A1 | 10/2015 | |
| WO | WO-2015165105 | A1 | 11/2015 | |
| WO | WO-2015172382 | A1 | 11/2015 | |
| WO | WO-2015172383 | A1 | 11/2015 | |
| WO | WO-2015172387 | A1 | 11/2015 | |
| WO | WO-2015180027 | A1 | 12/2015 | |
| WO | WO-2015180061 | A1 | 12/2015 | |
| WO | WO-2015180071 | A1 | 12/2015 | |
| WO | WO-2015180073 | A1 | 12/2015 | |
| WO | WO-2015184590 | A1 | 12/2015 | |
| WO | WO-2015192326 | A1 | 12/2015 | |
| WO | WO-2015192336 | A1 | 12/2015 | |
| WO | WO-2015000113 | A1 | 1/2016 | |
| WO | WO-2016000214 | A1 | 1/2016 | |
| WO | WO-2016058139 | A1 | 4/2016 | |
| WO | WO-201605533 | A1 | 5/2016 | |
| WO | WO-2016023177 | A1 | 5/2016 | |
| WO | WO-2016065598 | A1 | 5/2016 | |
| WO | WO-2016105191 | A1 | 6/2016 | |
| WO | WO-2016106500 | A1 | 7/2016 | |
| WO | WO-2016109965 | A1 | 7/2016 | |
| WO | WO-2016123770 | A1 | 8/2016 | |
| WO | WO-2016127361 | A1 | 8/2016 | |
| WO | WO-2016200252 | A1 | 12/2016 | |
| WO | WO-2016202303 | A1 | 12/2016 | |
| WO | WO-2017071297 | A1 | 5/2017 | |
| WO | WO-2017076590 | A1 | 5/2017 | |
| WO | WO-2017093452 | A1 | 6/2017 | |
| WO | WO-2017101705 | A1 | 6/2017 | |
| WO | WO-2017108429 | A1 * | 6/2017 | A24B 15/167 |
| WO | WO-2017121156 | A1 | 7/2017 | |
| WO | WO-2017153270 | A1 | 9/2017 | |
| WO | WO-2017205838 | A1 | 11/2017 | |
| WO | WO-2018048813 | A1 | 3/2018 | |
| WO | WO-2018146453 | A1 | 8/2018 | |
| WO | WO-2018208078 | A2 | 11/2018 | |
| WO | WO-2019100228 | A1 * | 5/2019 | |
| WO | WO-2020081849 | A2 | 4/2020 | |
| WO | WO-2020176902 | A2 | 9/2020 | |
| WO | WO-2020194286 | A1 * | 10/2020 | |
| WO | WO-2021076657 | A2 | 4/2021 | |

OTHER PUBLICATIONS

Pickling and Passivating Stainless Steel, Materials and Applications Series, vol. 4, Second Edition (Year: 2007).*

* cited by examiner

AEROSOL DISPENSING DEVICE WITH DISPOSABLE CONTAINER

CROSS REFERENCE TO RELATED APPLICATION

This application is a bypass continuation and claims priority to PCT/US2021/016568, filed on Feb. 4, 2021 and entitled "AEROSOL DISPENSING DEVICE WITH DISPOSABLE CONTAINER" which claims priority under 35 U.S.C. § 119(a) to U.S. Provisional Application No. 62/970,140, entitled "AEROSOL DISPENSING DEVICE WITH DISPOSABLE CONTAINER" and filed on Feb. 4, 2020, the disclosures of which are incorporated by reference herein in their entirety.

TECHNICAL FIELD

The subject matter described herein relates to vaporizer devices, including a cartridge coupled to a vaporizer body.

BACKGROUND

Vaporizer devices, which can also be referred to as vaporizers, electronic vaporizer devices or e-vaporizer devices, can be used for delivery of an aerosol (or "vapor") containing one or more active ingredients by inhalation of the aerosol by a user of the vaporizing device. For example, electronic cigarettes, which may also be referred to as e-cigarettes, are a class of vaporizer devices that are typically battery powered and that may be used to simulate the experience of cigarette smoking, but without burning of tobacco or other substances.

In use of a vaporizer device, the user inhales an aerosol, commonly called vapor, which may be generated by a heating element that vaporizes (which generally refers to causing a liquid or solid to at least partially transition to the gas phase) a vaporizable material, which may be liquid, a solution, a solid, a wax, or any other form as may be compatible with use of a specific vaporizer device. The vaporizable material used with a vaporizer can be provided within a cartridge (e.g., a part of the vaporizer that contains the vaporizable material in a reservoir) that includes a mouthpiece (e.g., for inhalation by a user).

To receive the inhalable aerosol generated by a vaporizer device, a user may, in certain examples, activate the vaporizer device by taking a puff, by pressing a button, or by some other approach. A puff, as the term is generally used (and also used herein), refers to inhalation by the user in a manner that causes a volume of air to be drawn into the vaporizer device such that the inhalable aerosol is generated by a combination of vaporized vaporizable material with the air.

A typical approach by which a vaporizer device generates an inhalable aerosol from a vaporizable material involves heating the vaporizable material in a vaporization chamber (or a heater chamber) to cause the vaporizable material to be converted to the gas (or vapor) phase. A vaporization chamber generally refers to an area or volume in the vaporizer device within which a heat source (e.g., conductive, convective, and/or radiative) causes heating of a vaporizable material to produce a mixture of air and vaporized vaporizable material to form a vapor for inhalation by a user of the vaporization device.

The term vaporizer device, as used herein consistent with the current subject matter, generally refers to portable, self-contained, devices that are convenient for personal use. Typically, such devices are controlled by one or more switches, buttons, touch sensitive devices, or other user input functionality or the like (which can be referred to generally as controls) on the vaporizer, although a number of devices that may wirelessly communicate with an external controller (e.g., a smartphone, a smart watch, other wearable electronic devices, etc.) have recently become available. Control, in this context, refers generally to an ability to influence one or more of a variety of operating parameters, which may include without limitation any of causing the heater to be turned on and/or off, adjusting a minimum and/or maximum temperature to which the heater is heated during operation, various games or other interactive features that a user might access on a device, and/or other operations.

Various vaporizable materials having a variety of contents and proportions of such contents can be contained in the cartridge. Some vaporizable materials, for example, may have a smaller percentage of active ingredients per total volume of vaporizable material, such as due to regulations requiring certain active ingredient percentages. As such, a user may need to vaporize a large amount of vaporizable material (e.g., compared to the overall volume of vaporizable material that can be stored in a cartridge) to achieve a desired effect.

SUMMARY

Aspects of the current subject matter relate to methods and system for dispensing a vaporizable material for vaporization. In one aspect, there is provided a vaporizer device that includes a vaporizer body. The vaporizer body may include a receptacle disposed at a proximal end of the body, a movable block, a controller, and a heating element. The receptacle may be configured to receive a cartridge while the cartridge is coupled with the vaporizer body. The cartridge may include a reservoir holding a vaporizable material. The cartridge may further include a channel extending from the reservoir and having an opening at an end of the channel. The controller may be configured to actuate the movable block. The actuating may move the movable block towards the channel to compress the channel. The compression of the channel may eject, from the opening at the end of the channel, at least a portion of the vaporizable material included in the reservoir. The heating element may be configured to vaporize the vaporizable material ejected from the opening of the channel.

In some variations, one or more of the following features may optionally be included in any feasible combination. The channel may be positioned proximate to the movable block when the cartridge is coupled with the vaporizer body.

In some variations, the heating element may be positioned towards the opening of the channel when the cartridge is coupled with the vaporizer body.

In some variations, the cartridge may further include a flow restrictor positioned at an inlet of the channel. The flow restrictor may be configured to prevent the vaporizable material in the channel from flowing back into the reservoir.

In some variations, the vaporizer body may further include a pair of electrodes. The pair of electrodes may be configured to detect at least the portion of the vaporizable being ejected from the opening of the channel. The heating element may be activated to vaporize the vaporizable material in response to the pair of electrodes detecting at least the portion of the vaporizable material being ejected from the opening of the channel In some variations, the vaporizer body may further include a sensor configured to measure an intensity of an inhalation on a mouthpiece of the cartridge.

In some variations, the controller may be further configured to actuate the movable block based on the intensity of the inhalation.

In some variations, the vaporizer body may further include a piezo stack coupled to the movable block. The controller may actuate the movable block by at least actuating the piezo stack.

In some variations, the cartridge may further include a venting hole configured to reduce a negative pressure in a portion of the reservoir.

In some variations, the cartridge may further include a hydrophobic membrane configured to attract one or more bubble that form within the vaporizable material in the reservoir.

In some variations, the vaporizer body may further include a power source. The power source may include a battery configured to provide power to the heating element.

In some variations, the cartridge may further include a filter positioned at an inlet of the channel. The filter may be configured to prevent one or more air bubbles from entering the channel.

In some variations, the channel may be formed from a ceramic and/or a metal.

In some variations, the channel may be formed from a plastic material including at least one of a polyimide, a polyetheretherketone, a polypropylene, and a polyethylene terephthalate.

In some variations, an inner wall of the channel may be formed from a hydrophobic material and/or includes a hydrophobic coating.

In some variations, the heating element may be a thermistor fabricated on a diaphragm.

In some variations, the heating element may further include a substrate. The diaphragm may be bonded to the substrate to form a hermetic chamber.

In some variations, the heating element may be detachable from the vaporizer body.

In some variations, the heating element may include one or more electrical contact pads.

In some variations, the heating element may include a passivation layer disposed on a surface of the heating element. The passivation layer may be configured to isolate the heating element and the thermistor from the vaporizable material.

In some variations, one or more surfaces of the heating element may be roughened in a microscale and/or a nanoscale.

In some variations, the channel may be positioned between a non-movable block and the movable block when the cartridge is coupled with the vaporizer body.

In some variations, one or more surfaces of the heating element may be treated with a hydrophilic treatment and/or a hydrophilic coating.

In another aspect, a method for dispensing a vaporizable material for vaporization is provided. The method may include: detecting, at a vaporizer device, an inhalation at a mouthpiece of a cartridge coupled to the vaporizer device, the cartridge including a reservoir holding a vaporizable material, and the cartridge further including a channel extending from the reservoir and having an opening at an end of the channel; and in response to detecting the inhalation, activating, by a controller of the vaporizer device, a movable block of the vaporizer device, the activating of the movable block moving the movable block towards the channel to compress the channel, and the compression of the channel ejecting, from the opening at the end of the channel, at least a portion of the vaporizable material included in the reservoir, activating, by the controller of the vaporizer device, the heating element to vaporize the vaporizable material ejected from the opening of the channel, the vaporization of the vaporizable material generating an aerosol, and providing, via an air flow path, the aerosol to the user.

In some variations, one or more of the following features may optionally be included in any feasible combination. The controller may be configured to activate the movable block and/or the heating element in response to an intensity of the inhalation being above a threshold value.

In some variations, the movable block may be activated to move at a frequency determined based at least on an intensity of the inhalation.

In some variations, the controller may activate the movable block by at least actuating a piezo stack coupled with the movable block.

In some variations, the controller may activate the heating element by at least activating a power source coupled with the heating element to increase a temperature of the heating element.

In some variations, the method may further include detecting, by a pair of electrodes, at least the portion of the vaporizable being ejected from the opening of the channel.

In some variations, the controller may activate the heating element further in response to the pair of electrodes detecting at least the portion of the vaporizable being ejected from the opening of the channel.

The details of one or more variations of the subject matter described herein are set forth in the accompanying drawings and the description below. Other features and advantages of the subject matter described herein will be apparent from the description and drawings, and from the claims.

BRIEF DESCRIPTION OF THE DRAWINGS

The accompanying drawings, which are incorporated in and constitute a part of this specification, show certain aspects of the subject matter disclosed herein and, together with the description, help explain some of the principles associated with the disclosed implementations. In the drawings.

When practical, similar reference numbers denote similar structures, features, or elements.

DETAILED DESCRIPTION

Implementations of the current subject matter include devices relating to vaporizing of one or more materials for inhalation by a user. The term "vaporizer" is used generically in the following description to refer to a vaporizer device. Examples of vaporizers consistent with implementations of the current subject matter include electronic vaporizers, electronic cigarettes, e-cigarettes, or the like. Such vaporizers are generally portable, hand-held devices that heat a vaporizable material to provide an inhalable dose of the material.

The vaporizable material used with a vaporizer may optionally be provided within a cartridge (e.g., a part of the vaporizer that contains the vaporizable material in a reservoir or other container and that can be refillable when empty or disposable in favor of a new cartridge containing additional vaporizable material of a same or different type). A vaporizer may be a cartridge-using vaporizer, a cartridge-less vaporizer, or a multi-use vaporizer capable of use with or without a cartridge. For example, a multi-use vaporizer may include a heating chamber (e.g., an oven) configured to receive a vaporizable material directly in the heating chamber and also to receive a cartridge or other replaceable device having a reservoir, a volume, or the like for at least partially containing a usable amount of vaporizable material.

In various implementations, a vaporizer may be configured for use with liquid vaporizable material (e.g., a carrier solution in which an active and/or inactive ingredient(s) are suspended or held in solution or a neat liquid form of the vaporizable material itself) or a solid vaporizable material. A solid vaporizable material may include a plant material that emits some part of the plant material as the vaporizable material (e.g., such that some part of the plant material remains as waste after the vaporizable material is emitted for inhalation by a user) or optionally can be a solid form of the vaporizable material itself (e.g., a "wax") such that all of the solid material can eventually be vaporized for inhalation. A liquid vaporizable material can likewise be capable of being completely vaporized or can include some part of the liquid material that remains after all of the material suitable for inhalation has been consumed.

Figure 1A:
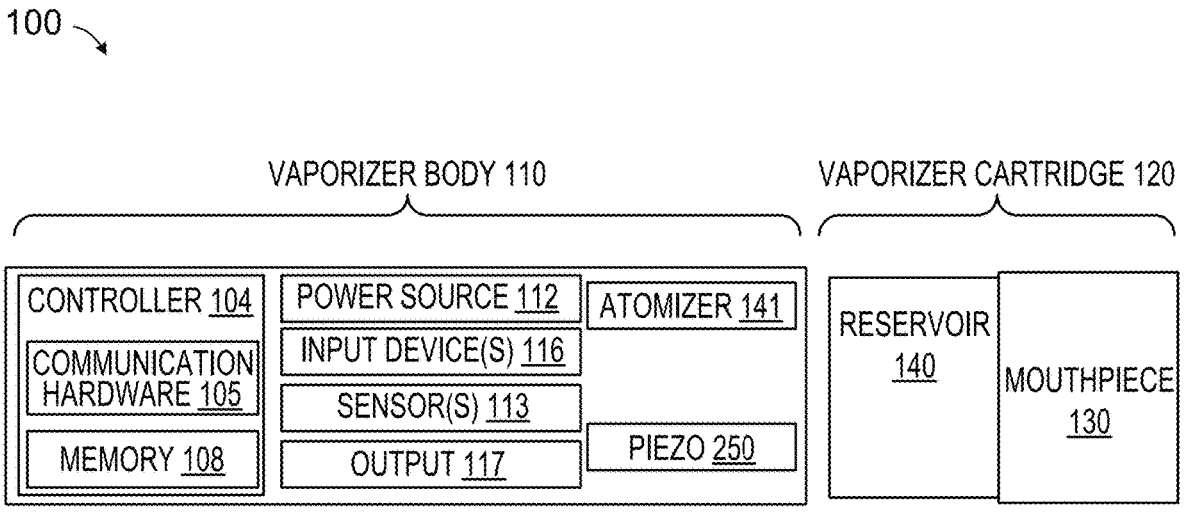
FIG. 1A illustrates a block diagram of a vaporizer consistent with implementations of the current subject matter.

Referring to the block diagram of FIG. 1A, a vaporizer 100 typically includes a power source 112 (such as a battery which may be a rechargeable battery), and a controller 104 (e.g., a processor, circuitry, etc. capable of executing logic) for controlling delivery of heat to an atomizer 141 to cause a vaporizable material to be converted from a condensed form (e.g., a solid, a liquid, a solution, a suspension, a part of an at least partially unprocessed plant material, etc.) to the gas phase. The controller 104 may be part of one or more printed circuit boards (PCBs) consistent with certain implementations of the current subject matter.

After conversion of the vaporizable material to the gas phase, and depending on the type of vaporizer, the physical and chemical properties of the vaporizable material, and/or other factors, at least some of the gas-phase vaporizable material may condense to form particulate matter in at least a partial local equilibrium with the gas phase as part of an aerosol, which can form some or all of an inhalable dose provided by the vaporizer 100 for a given puff or draw on the vaporizer. It will be understood that the interplay between gas and condensed phases in an aerosol generated by a vaporizer can be complex and dynamic, as factors such as ambient temperature, relative humidity, chemistry, flow conditions in airflow paths (both inside the vaporizer and in the airways of a human or other animal), mixing of the gas-phase or aerosol-phase vaporizable material with other air streams, etc. may affect one or more physical parameters of an aerosol. In some vaporizers, and particularly for vaporizers for delivery of more volatile vaporizable materials, the inhalable dose may exist predominantly in the gas phase (i.e., formation of condensed phase particles may be very limited).

Vaporizers for use with liquid vaporizable materials (e.g., neat liquids, suspensions, solutions, mixtures, etc.) typically include an atomizer 141 having a heating element (not shown in FIG. 1A).

The heating element can be or include one or more of a conductive heater, a radiative heater, and a convective heater. One type of heating element is a resistive heating element, which can be constructed of or at least include a material (e.g., a metal or alloy, for example a nickel-chromium alloy, or a non-metallic resistor) configured to dissipate electrical power in the form of heat when electrical current is passed through one or more resistive segments of the heating element. In some implementations of the current subject matter, an atomizer can include a heating element. Other heating element, and/or atomizer assembly configurations are also possible, as discussed further below.

Certain vaporizers may also or alternatively be configured to create an inhalable dose of gas-phase and/or aerosol-phase vaporizable material via heating of a non-liquid vaporizable material, such as for example a solid-phase vaporizable material (e.g., a wax or the like) or plant material (e.g., tobacco leaves and/or parts of tobacco leaves) containing the vaporizable material. In such vaporizers, a resistive heating element may be part of or otherwise incorporated into or in thermal contact with the walls of an oven or other heating chamber into which the non-liquid vaporizable material is placed. Alternatively, a resistive heating element or elements may be used to heat air passing through or past the non-liquid vaporizable material to cause convective heating of the non-liquid vaporizable material. In still other examples, a resistive heating element or elements may be disposed in intimate contact with plant material such that direct conductive heating of the plant material occurs from within a mass of the plant material (e.g., as opposed to only by conduction inward form walls of an oven).

The heating element may be activated (e.g., a controller, which is optionally part of a vaporizer body as discussed below, may cause current to pass from the power source through a circuit including the resistive heating element, which is optionally part of a vaporizer cartridge as discussed below), in association with a user puffing (e.g., drawing, inhaling, etc.) on a mouthpiece 130 of the vaporizer to cause air to flow from an air inlet, along an airflow path that passes a heating element), optionally through one or more condensation areas or chambers, to an air outlet in the mouthpiece. Incoming air passing along the airflow path passes over, through, etc. the heating element, where gas phase vaporizable material is entrained into the air. As noted above, the entrained gas-phase vaporizable material may condense as it passes through the remainder of the airflow path such that an inhalable dose of the vaporizable material in an aerosol form can be delivered from the air outlet (e.g., in a mouthpiece 130 for inhalation by a user).

Activation of the heating element may be caused by automatic detection of the puff based on one or more of signals generated by one or more sensors 113, such as for example a pressure sensor or sensors disposed to detect pressure along the airflow path relative to ambient pressure (or optionally to measure changes in absolute pressure), one or more motion sensors of the vaporizer, one or more flow sensors of the vaporizer, a capacitive lip sensor of the vaporizer; in response to detection of interaction of a user with one or more input devices 116 (e.g., buttons or other tactile control devices of the vaporizer 100), receipt of signals from a computing device in communication with the vaporizer; and/or via other approaches for determining that a puff is occurring or imminent.

As alluded to in the previous paragraph, a vaporizer consistent with implementations of the current subject matter may be configured to connect (e.g., wirelessly or via a wired connection) to a computing device (or optionally two or more devices) in communication with the vaporizer. To this end, the controller 104 may include communication hardware 105. The controller 104 may also include a memory 108. A computing device can be a component of a vaporizer system that also includes the vaporizer 100, and can include its own communication hardware, which can establish a wireless communication channel with the communication hardware 105 of the vaporizer 100. For example, a computing device used as part of a vaporizer system may include a general purpose computing device (e.g., a smartphone, a tablet, a personal computer, some other portable device such as a smartwatch, or the like) that executes software to produce a user interface for enabling a user of the device to interact with a vaporizer. In other implementations of the current subject matter, such a device used as part of a vaporizer system can be a dedicated piece of hardware such as a remote control or other wireless or wired device having one or more physical or soft (e.g., configurable on a screen or other display device and selectable via user interaction with a touch-sensitive screen or some other input device like a mouse, pointer, trackball, cursor buttons, or the like) interface controls. The vaporizer can also include one or more output 117 features or devices for providing information to the user.

A computing device that is part of a vaporizer system as defined above can be used for any of one or more functions, such as controlling dosing (e.g., dose monitoring, dose setting, dose limiting, user tracking, etc.), controlling sessioning (e.g., session monitoring, session setting, session limiting, user tracking, etc.), controlling nicotine delivery (e.g., switching between nicotine and non-nicotine vaporizable material, adjusting an amount of nicotine delivered, etc.), obtaining locational information (e.g., location of other users, retailer/commercial venue locations, vaping locations, relative or absolute location of the vaporizer itself, etc.), vaporizer personalization (e.g., naming the vaporizer, locking/password protecting the vaporizer, adjusting one or more parental controls, associating the vaporizer with a user group, registering the vaporizer with a manufacturer or warranty maintenance organization, etc.), engaging in social activities (e.g., games, social media communications, interacting with one or more groups, etc.) with other users, or the like. The terms "sessioning", "session", "vaporizer session," or "vapor session," are used generically to refer to a period devoted to the use of the vaporizer. The period can include a time period, a number of doses, an amount of vaporizable material, and/or the like.

In the example in which a computing device provides signals related to activation of the resistive heating element, or in other examples of coupling of a computing device with a vaporizer for implementation of various control or other functions, the computing device executes one or more computer instructions sets to provide a user interface and underlying data handling. In one example, detection by the computing device of user interaction with one or more user interface elements can cause the computing device to signal the vaporizer 100 to activate the heating element, either to a full operating temperature for creation of an inhalable dose of vapor/aerosol. Other functions of the vaporizer may be controlled by interaction of a user with a user interface on a computing device in communication with the vaporizer.

The temperature of a resistive heating element of a vaporizer may depend on a number of factors, including an amount of electrical power delivered to the resistive heating element and/or a duty cycle at which the electrical power is delivered, conductive heat transfer to other parts of the electronic vaporizer and/or to the environment, latent heat losses, and convective heat losses due to airflow (e.g., air moving across the heating element or the atomizer as a whole when a user inhales on the electronic vaporizer). As noted above, to reliably activate the heating element or heat the heating element to a desired temperature, a vaporizer may, in some implementations of the current subject matter, make use of signals from a pressure sensor to determine when a user is inhaling. The pressure sensor can be positioned in the airflow path and/or can be connected (e.g., by a passageway or other path) to an airflow path connecting an inlet for air to enter the device and an outlet via which the user inhales the resulting vapor and/or aerosol such that the pressure sensor experiences pressure changes concurrently with air passing through the vaporizer device from the air inlet to the air outlet. In some implementations of the current subject matter, the heating element may be activated in association with a user's puff, for example by automatic detection of the puff, for example by the pressure sensor detecting a pressure change in the airflow path.

Typically, the pressure sensor (as well as any other sensors 113) can be positioned on or coupled (e.g., electrically or electronically connected, either physically or via a wireless connection) to the controller 104 (e.g., a printed circuit board assembly or other type of circuit board). To take measurements accurately and maintain durability of the vaporizer, it can be beneficial to provide a resilient seal (not shown) to separate an airflow path from other parts of the vaporizer 100. The seal, which can be a gasket, may be configured to at least partially surround the pressure sensor such that connections of the pressure sensor to internal circuitry of the vaporizer are separated from a part of the pressure sensor exposed to the airflow path. In an example of a cartridge-based vaporizer, the seal may also separate parts of one or more electrical connections between a vaporizer body 110 and a vaporizer cartridge 120. Such arrangements of the seal in the vaporizer 100 can be helpful in mitigating against potentially disruptive impacts on vaporizer components resulting from interactions with environmental factors such as water in the vapor or liquid phases, other fluids such as the vaporizable material, etc. and/or to reduce escape of air from the designed airflow path in the vaporizer. Unwanted air, liquid or other fluid passing and/or contacting circuitry of the vaporizer can cause various unwanted effects, such as alter pressure readings, and/or can result in the buildup of unwanted material, such as moisture, the vaporizable material, etc. in parts of the vaporizer where they may result in poor pressure signal, degradation of the pressure sensor or other components, and/or a shorter life of the vaporizer. Leaks in the seal can also result in a user inhaling air that has passed over parts of the vaporizer device containing or constructed of materials that may not be desirable to be inhaled.

A vaporizer may include a vaporizer body 110 that includes a controller 104, a power source 112 (e.g., battery), one more sensors 113, an atomizer 141, and a piezo stack 250 configured to control, via actuation as further described herein, a delivery rate of vaporizable material to the heating element. In some examples, vaporizer cartridge 120 includes a reservoir 140 for containing a liquid vaporizable material and a mouthpiece 130 for delivering an inhalable dose to a user. The vaporizer cartridge 120 can include a heating element (alternatively, the heating element can be part of the vaporizer body 110). In implementations in which the heating element is part of the vaporizer body 110, the vaporizer 100 can be configured to supply liquid vaporizable material from a reservoir 140 in the vaporizer cartridge 120 to the atomizer 141 part(s) included in the vaporizer body 110.

Cartridge-based configurations for vaporizers that generate an inhalable dose of a non-liquid vaporizable material via heating of a non-liquid vaporizable material are also within the scope of the current subject matter. For example, a vaporizer cartridge may include a mass of a plant material that is processed and formed to have direct contact with parts of one or more resistive heating elements, and such a vaporizer cartridge may be configured to be coupled mechanically and electrically to a vaporizer body that includes a processor, a power source, one or more sensors, and/or the like.

In one example of an attachment structure for coupling a vaporizer cartridge 120 to a vaporizer body, the vaporizer body 110 includes a detent (e.g., a dimple, protrusion, etc.) protruding inwardly from an inner surface the vaporizer body 110. One or more exterior surfaces of the vaporizer cartridge 120 can include corresponding recesses (not shown in FIG. 1A) that can fit and/or otherwise snap over such detents when an end of the vaporizer cartridge 120 inserted into the vaporizer body 110. When the vaporizer cartridge 120 and the vaporizer body 110 are coupled, the detent into the vaporizer body 110 may fit within and/or otherwise be held within the recesses of the vaporizer cartridge 120 to hold the vaporizer cartridge 120 in place when assembled. Such a detent-recess assembly can provide enough support to hold the vaporizer cartridge 120 in place to ensure good contact between the vaporizer body 110 and vaporizer cartridge 120, while allowing release of the vaporizer cartridge 120 from the vaporizer body 110 when a user pulls with reasonable force on the vaporizer cartridge 120 to disengage the vaporizer cartridge 120 from the vaporizer body 110. While a detent and recess are described above, other attachment structures are possible for coupling the vaporizer cartridge 122 the vaporizer body 110.

In some examples, the vaporizer cartridge 120, or at least an end of the vaporizer cartridge 120 may be configured for insertion in at least a portion of the vaporizer body 110. The vaporizer cartridge 120, or at least an end of the vaporizer cartridge 120 may have a non-circular cross section transverse to the axis along which the vaporizer cartridge 120 is inserted into the vaporizer body 110. For example, the non-circular cross section may be approximately rectangular, approximately elliptical (e.g., have an approximately oval shape), non-rectangular but with two sets of parallel or approximately parallel opposing sides (e.g., having a parallelogram-like shape), or other shapes having rotational symmetry of at least order two. In this context, approximately having a shape indicates that a basic likeness to the described shape is apparent, but that sides of the shape in question need not be completely linear and vertices need not be completely sharp. Rounding of both or either of edges or vertices of the cross-sectional shape is contemplated in the description of any non-circular cross section referred to herein.

Figure 1B:
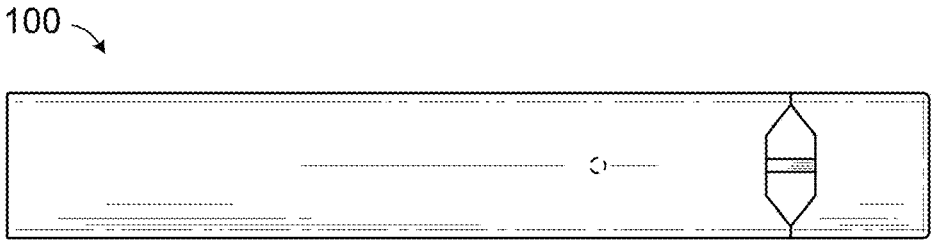
FIG. 1B illustrates an example variation of a vaporizer and cartridge assembly consistent with implementations of the current subject matter.

FIG. 1B shows a top view of the combined vaporizer body 110 and cartridge 120. FIG. 1B shows an example including many of the features generally shown in FIG. 1A. Other configurations, including some or all of the features described herein, are also within the scope of the current subject matter.

In cartridge-based implementations, it may be desirable to reduce complexity of the cartridge 120, for example, by eliminating and/or consolidating one or more components of the cartridge 120 such as the heating element. In some aspects, vaporizable material may leak from the cartridge 120 when the cartridge 120 is coupled to the vaporizer body 110 and the vaporizer 100 is positioned in a variety of orientations including an upright orientation. Additionally, when heating the vaporizable material in the cartridge 120, portions of the vaporizable material adjacent or proximate to the heating element may be unintentionally heated between puffs because the heating element may remain above a threshold temperature for a time period even when minimal or no electrical current is passing through the heating element. As such, subjecting the vaporizable material to unintentional heat may adulterate the vaporizable material and prevent the vaporizer device from delivering an aerosol having a desired flavor by merely measuring and/or controlling the amount of vaporizable material that is heated for delivery to the user. Embodiments described herein may include a more reliable and a higher efficiency heating element than other designs.

Figure 2A:
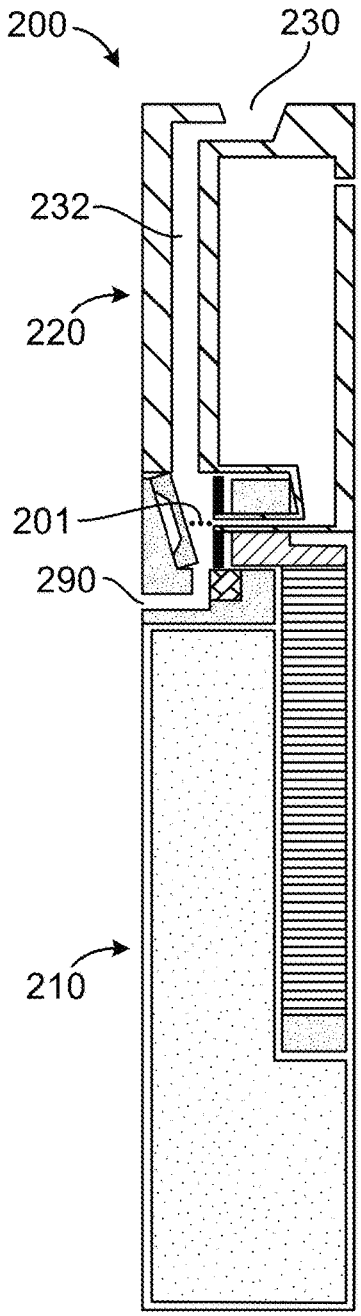
FIGS. 2A-2C illustrates example variations of a cartridge and vaporizer body assembly of a vaporizer consistent with implementations of the current subject matter.
Figure 2B:
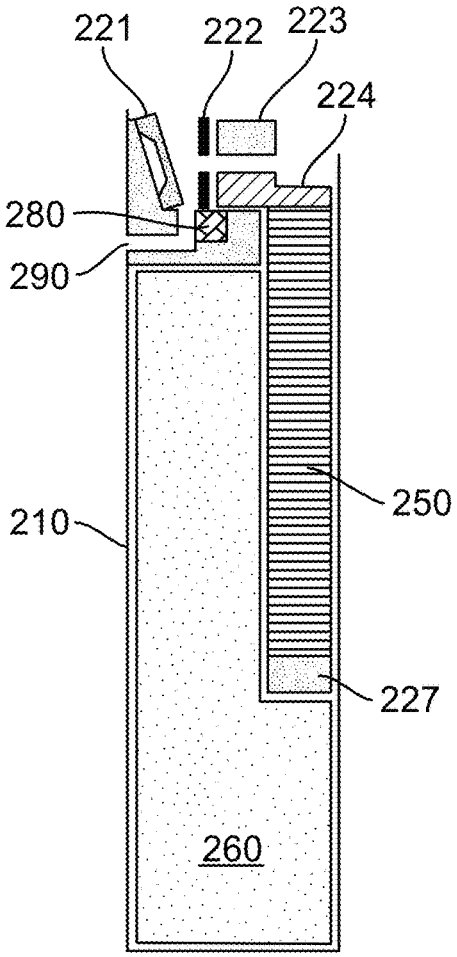
Figure 2C:
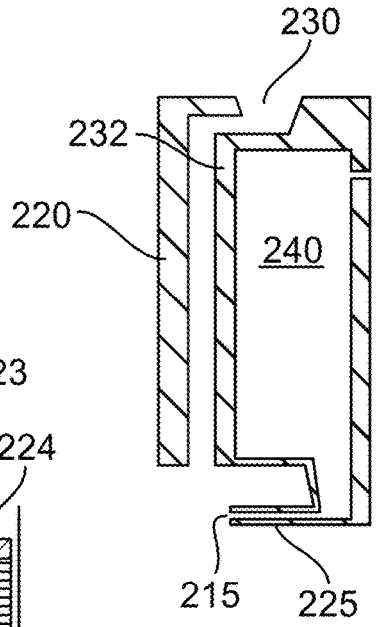

FIGS. 2A-2C illustrate example variations of the cartridge 120 and the vaporizer body 110 of the vaporizer 100 consistent with implementations of the current subject matter. As shown, the cartridge 120 may be configured to be a disposable and the vaporizer body 110 may be configured to be reusable. The cartridge 120 may be coupled to the vaporizer body 110 during normal operation (as shown as vaporizer 100 in FIG. 2A) and the cartridge 120 may be detached from the vaporizer body 110 by the user in order to replace the cartridge 120 with another cartridge 120. FIG. 2C shows the cartridge 120 as including the reservoir 140, a fluid channel 225, an aerosol path 232, and a mouthpiece 130. A vaporizable material (e.g., E-liquid) may be stored in the reservoir 140 and may fill fluid channel 225 with e-liquid through capillary force and/or hydrostatic pressure. The fluid channel 225 may include an orifice 215 at its end (as shown in FIG. 2C).

As shown in FIG. 2A, the cartridge 120 may be coupled to the vaporizer body 110 when the vaporizer 100 is in use. The vaporizer body 110 may include the atomizer 141 configured to cause a vaporization of the vaporizable material (e.g., E-liquid) stored in the reservoir 140 of the cartridge 120 for subsequent inhalation by a user in a gas phase and/or a condensed phase (e.g., aerosol particles or droplets). In the example of the vaporizer body 110 shown in FIGS. 2A-B, the atomizer 141 may include a heater 221, an electrode pair 222, a first non-movable block 223, a movable block 224, one or more piezo stacks 250, and a second non-movable block 227. The fluid channel 225 in the cartridge 120 may be positioned between the first non-movable block 223 and the movable block 224 with the orifice 215 facing towards the heater plate 221.

The first non-movable block 223 may be configured to remain stationary whereas the movable block 224 may be configured to be mobile, for example, in one or more directions. Moreover, the movable block 224 may be coupled to the piezo stacks 250. The piezo stacks 250 may be fixed to the second non-movable block 227 at one end and the movable block 224 at an opposite end. The piezo stacks 250 may be preloaded or non-preloaded. Activation of the piezo stack 250 may result in an upward force against the movable block 224 which may in turn compress (e.g., squeeze) the fluid channel 225 to cause an ejection of the vaporizable material from the fluid channel 225 via orifice 215 towards the heater plate 221 (e.g. via a path 201 shown in FIG. 2A). Meanwhile, activating the power source 112, for example, a battery 260, included in the reusable vaporizer body 110 may cause an increase in a temperature of the heater plate 221 such that the heater plate 221 is capable of heating the vaporizable material to a temperature sufficient to vaporize the vaporizable material.

FIG. 2B shows components of an example vaporizer body 110. As shown in FIG. 2B, the reusable vaporizer body 110 may include the sensors 113, which may include one or more sensors configured to detect whether one or more droplets of the vaporizable material have been ejected from the fluid channel 225. For example, the reusable vaporizer body 110 may include a pair of electrodes 222, which may be disposed at opposite sides of the path 201. When one or more droplet of the vaporizable material are present between the electrode pair 222, the capacitance between the electrodes pair 222 may change. Accordingly, the controller 104 may determine whether to the battery 260 to power the heater plate 221 based at least on the capacitance between the electrode pair 222. For example, the controller 104 included in the reusable vaporizer body 110 may activate the battery 260 in response to the capacitance between the electrode pair 222 exceeding a threshold value indicative of the presence of droplets of vaporizable material between the electrode pair 222. That is, the controller 104 may activate the battery 260 (e.g., to activate the heater plate 221) when the capacitance between the electrode pair 222 indicates that one or more droplets of the vaporizable material have been successfully ejected from the fluid channel 225. It should be appreciated that instead of the electrode pair 222, the reusable vaporizer body 110 may include a different type of sensor capable of detecting the presence of droplets of the vaporizable material such as, for example, an LED emitter and detector.

Referring again to FIGS. 2A-B, in some implementations of the current subject matter, the one or more sensors 113 may also include an inhalation sensor 280. The inhalation sensor 280, which may include a flow sensor, a pressure sensor, or a microphone, may be configured to measure an intensity of the user's inhalation (e.g., whether the user inhales strongly or lightly). When user inhales through the mouthpiece 130, air may flow into the vaporizer 100 through an opening 290 and the intensity of the inhalation may be measured by the inhalation sensor 280. The controller 104 may respond to the sensor 280 detecting an inhalation (e.g., an inhalation having an above threshold intensity) by at least actuating the piezo stacks 250 to eject vaporizable material onto the heater plate 221 and/or activating the battery 260 to power the heater plate 221 to cause a vaporization of the vaporizable material.

The delivery rate of the vaporizable material may be controlled by the displacement of the piezo stacks 250 and/or the actuation frequency of the piezo stacks 250. Moreover, a droplet size of the vaporizable material exiting the channel 225 may also be adjusted based on the displacement of the piezo stacks 250 and/or the actuation frequency of the piezo stacks 250. For example, the controller 104 may be configured to apply an electrical charge to the piezo stacks 250 to actuate the piezo stacks 250, which may in turn move the movable block 224 to compress the channel 225 and the vaporizable material to be ejected from the channel 225 via the orifice 215. The piezo stacks 250 may expand or contract when an electrical charge is applied. The delivery rate of the vaporizable material may be controlled by the frequency of electrical signal applied by the controller 104 to the piezo stacks 250. In some aspects, the amount of power delivered to the heater 221 (e.g., an operating temperature of the heater 221) may be adjusted to be proportional to the droplet size and/or the delivery rate of the vaporizable material. The increased control over droplet size and delivery rate may enable the controller 104 to predict the power requirements of the heater 221 and improve power efficiency and/or battery life for the vaporizer. Control over droplet size and delivery rate may also provide a user with a consistent flavor from puff to puff over the life of the cartridge 120. The generated aerosol may travel with the air flow, passing through the aerosol path 232 and the mouth piece 130 for eventual inhalation by the user.

Figure 3A:
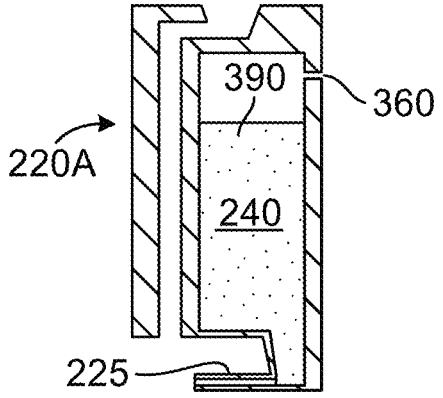
FIGS. 3A-3D illustrates example cartridge designs consistent with implementations of the current subject matter.

FIGS. 3A-3D illustrate example embodiments of the cartridge 120 consistent with implementations of the current subject matter. FIG. 3A shows an example of the cartridge 120 in which a vaporizable material 390 is held within the reservoir 140 and the channel 225. The example of the cartridge 120 shown in FIG. 3A also includes a venting hole 360 at a superior portion of the reservoir 140. The venting hole 360 may be configured to allow pressure inside the reservoir 140 to reach equilibrium with an ambient pressure around the cartridge 120. The vaporizable material 390 may be configured such that a surface tension of the vaporizable material 390 may prevent the vaporizable material 390 from entering into and/or leaking through the venting hole 360. It should be appreciated that while a specific location for the venting hole 360 is shown in FIGS. 3A-3D, other locations for the venting hole 360 are possible. For example, the venting hole 360 may be positioned at a lower portion of the reservoir 140 (e.g., closer to the channel 225).

After the certain quantity of the vaporizable material 390 (e.g., e-liquid) of the reservoir 140 is ejected from the fluid channel 225, air may enter into the reservoir 140 through the venting hole 360 and may travel upwards into the headspace of the reservoir 140 (e.g., void volume inside the reservoir 140 caused by the vaporizable material 390 being drawn from the reservoir 140). Drawing portions of the vaporizable material 390 from the reservoir 140 may cause the pressure inside the reservoir 140 to decrease, for example, below the ambient pressure surrounding the reservoir 140. In the absence of a pressure equalization mechanism such as the venting hole 360, a vacuum may eventually develop within the reservoir 140 and inhibit the capillary action that draws the vaporizable material 390 into the fluid channel 225. The lowered pressure (or vacuum) inside the reservoir 140 may therefore prevent further withdrawal of the vaporizable material 390 by at least preventing the vaporizable material 390 from entering the fluid channel 225 for subsequent ejection. Accordingly, in some implementations of the current subject matter, air is introduced into the reservoir 140 through the venting hole 360 in order to equalize the pressure inside the reservoir 140 with the ambient pressure surrounding the reservoir. Doing so may enable the vaporizable material 390 to enter the fluid channel 225 and facilitate further withdrawal of the vaporizable material 390 from the reservoir 140.

Figure 3C:
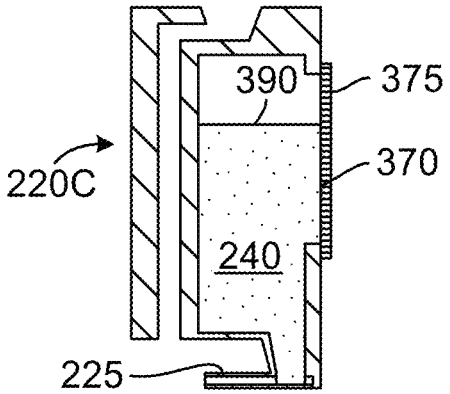
Figure 3B:
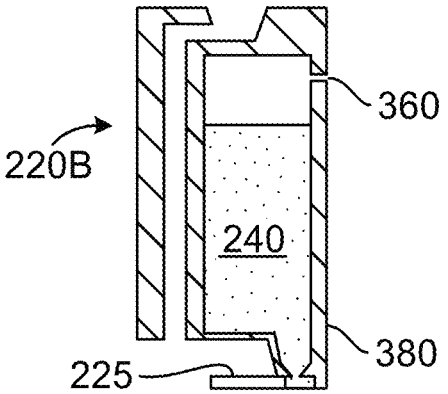

FIG. 3B shows another example of the cartridge 120 including a flow restrictor 380 positioned at an inlet of the channel 225. The flow restrictor 380 may be configured to facilitate the ejection of the vaporizable material 390 from the orifice 215. For example, when the block 224 moves upward, the block 224 may create, inside the channel 225, pressure squeezing the vaporizable material 390 inside the channel 225 to flow either out through the orifice 215 or back into the reservoir 140. The flow restrictor 380 may provide resistance to prevent the vaporizable material 390 from flowing back to the reservoir 140. As such, the flow restrictor 380 may encourage droplets of the vaporizable material 390 inside the channel 225 to flow out of the orifice 215 instead of back into the reservoir 140.

FIG. 3C shows another example of the cartridge 120 including a membrane 375. The membrane 375 may be formed from a hydrophobic material such as, for example, polytetrafluoroethylene (PTFE) and/or the like. Alternatively and/or additionally, the membrane 375 may be coated with a hydrophobic material such as a polytetrafluoroethylene (PTFE) and/or the like. As such, the membrane 375 may be configured to attract and burst a bubble 370 within the vaporizable material 390 in the reservoir 140.

Figure 3D:
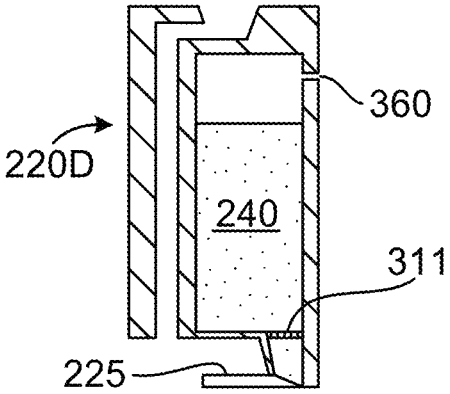

FIG. 3D shows another example of the cartridge 120, which may include a filter 311 at an inlet to the channel 225. The filter 311 may be configured to prevent bubbles (e.g., bubble 370) from entering the channel 225.

Figure 4A:
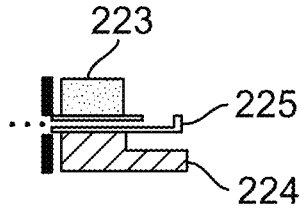
FIGS. 4A-4C illustrate example channel designs of the cartridge consistent with implementations of the current subject matter.
Figure 4B:
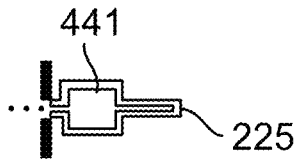
Figure 4C:
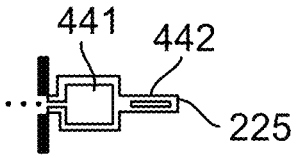

FIGS. 4A-4C illustrate an example embodiments of the channel 225 for the cartridge 120 consistent with implementations of the current subject matter. The channel 225 may be in a tube shape with the same cross section extended beyond its nozzle (e.g. orifice 215).

FIG. 4A depicts an example of the channel 225 disposed between the first non-movable block 223 and the movable block 224. In another embodiment, the tube channel 225 may contain an enlarged microfluidic chamber 441 in a middle region of the channel 225 where the movable block 224 may contact when the piezo stack 250 is activated. FIG. 4B is the top view of FIG. 4A. FIG. 4C depicts a flow restrictor 442 disposed at an entrance of the fluid chamber 441. Flow restrictor 442 may facilitate the ejection of the droplets similar to the flow restrictor 380.

Figure 5:
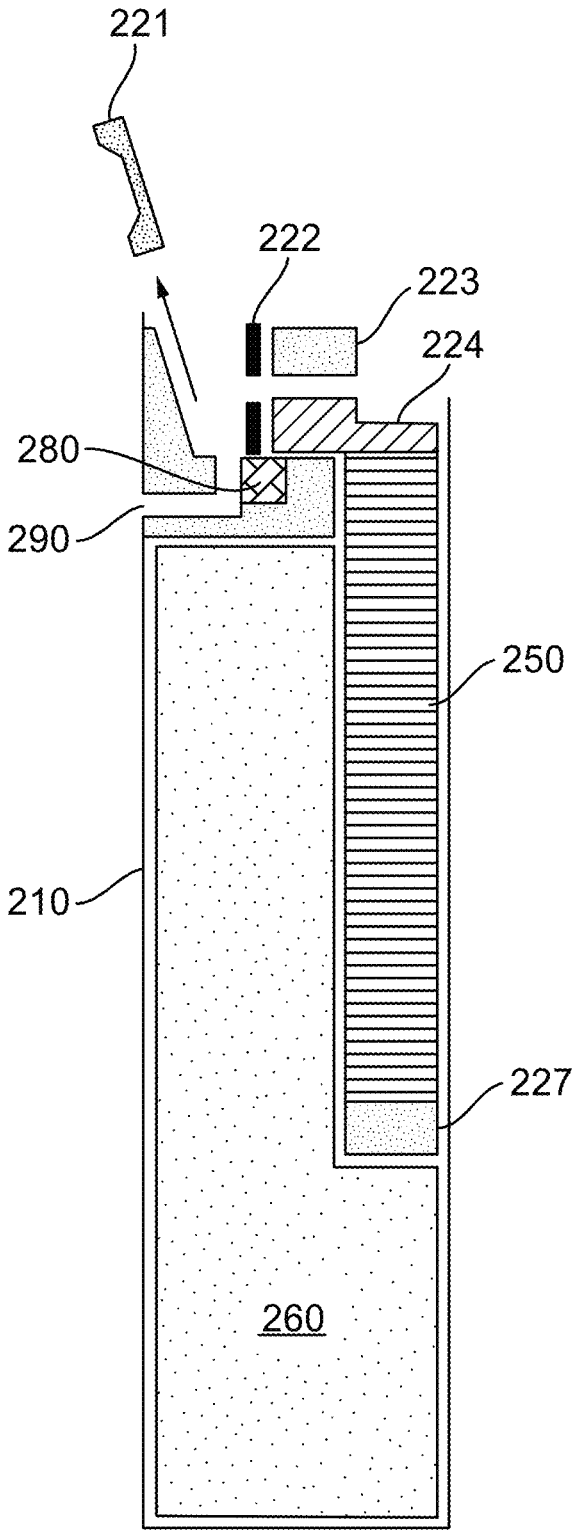
FIG. 5 illustrates an example variation of a detachable heater, consistent with implementations of the current subject matter.

FIG. 5 illustrates an example variation of a detachable heater plate 221 of the vaporizer body 110, consistent with implementations of the current subject matter. As shown, the heater plate 221 may be detached from the vaporizer body 510 by a user and replaced with a new one. In some implementations, the heater plate 221 may be replaced at regular time intervals and/or after consuming a certain quantity of cartridges. In some aspects, the heater plate 221 may have the same or better shelf life compared to other components in the vaporizer body 110 so that one single heater plate 221 may be used throughout the shelf life of the vaporizer body 110. However, in practice, the heater plate 221 may get contaminated, damaged, or broken and may require immediate replacement.

Figure 6A:
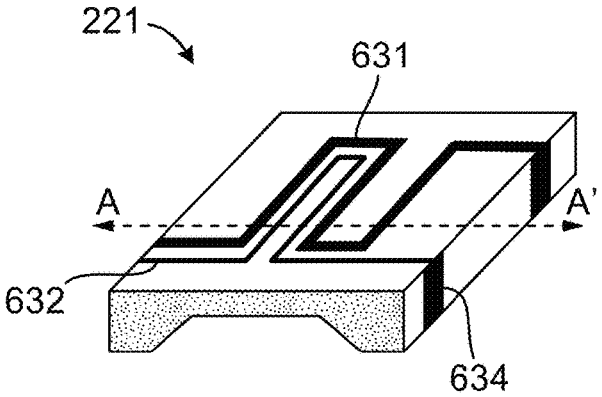
FIGS. 6A-6D illustrate example variations of a heating element, consistent with implementations of the current subject matter.

FIGS. 6A-6D illustrate examples implementations of the heater plate 221 consistent with implementations of the current subject matter. As shown in the example of FIG. 6A, the heater plate 221 may contain a heating element 631 and a thermistor 632 fabricated on a diaphragm 633. The heater plate 221 may electrically connect to controller circuits (e.g., the controller 104) and the battery 260 of the vaporizer 100 through contact pads 634. The diaphragm 633 may be configured to reduce the thermal mass of the heater plate 221 and thus mitigate lateral thermal dissipation. It may also be possible to fabricate the heating element 631 on a substrate (e.g., a substrate 635 of FIG. 6B) instead of the diaphragm 633. The substrate 635 and the diaphragm 633 may be formed from a low thermal conductivity material such as, for example, a low temperature co-fired ceramic (LTCC) substrate, a glass, and/or the like.

Figure 6B:
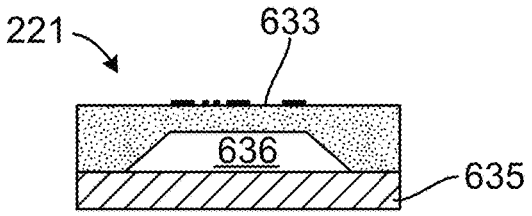
Figure 6C:
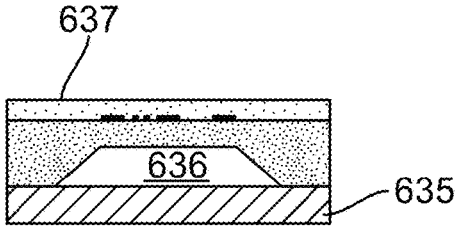
Figure 6D:
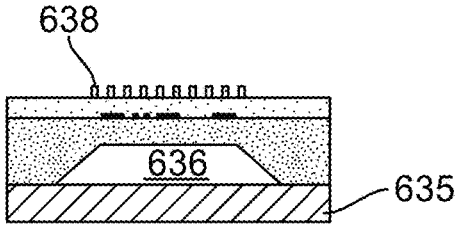

To even further reduce the thermal dissipation, the heater plate 221 may include a hermetic chamber 636 formed, for example, by bonding the diaphragm 633 with the substrate 635. FIG. 6B depicts an example of the heater plate 221 including the hermetic chamber 636. The chamber 636 may contain air or may be empty (e.g., a vacuum). A thin passivation layer 637 may be deposited on the heating element 631 and the thermistor 632 in order to isolate these components from the vaporizable material. FIG. 6C depicts an example of the heater plate 221 including the passivation layer 637. It may also be possible to deposit a layer of high thermal conductive material on top of the heating element 631 as a thermal spreader. The high thermal conductive material, such as copper, aluminum, or the like, may increase the evaporation rate of the vaporizable material on the heater 221 as well as promote the wetting/spreading of the vaporizable material on the heater 221. The surface of the heater plate 221 may include a microscale 638 and/or a nanoscale in order to roughen the surface of the heater plate 221. FIG. 6D depicts an example of the heater plate 221 including microscale 638. For hydrophilic treatment, the heating element 631 may include an intrinsically hydrophilic top layer (e.g., $SiO_2$) or the top surface of the heating element 631 may be coated with hydrophilic coatings (e.g., silanes). A roughened and hydrophilic coating treated surface of the heating element 631 may increase the evaporation rate of the e-liquid on the heater 221 and may reduce the required operating temperature.

Figure 7:
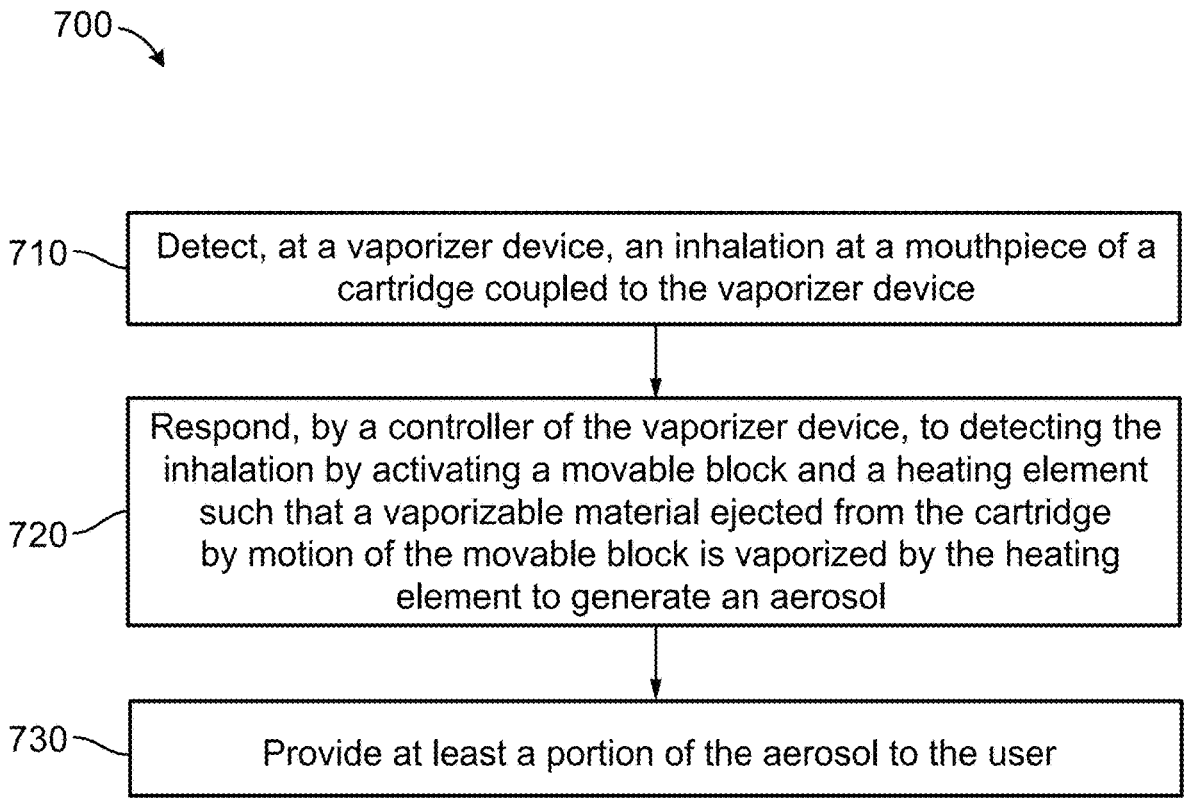
FIG. 7 depicts a flowchart illustrating an example of a process for controlling an amount of vaporizable material delivered to a heating element, in accordance with some example embodiments.

FIG. 7 depicts a flowchart illustrating an example of a process 700 for controlling an amount of vaporizable material delivered to a heating element, in accordance with some example embodiments. Referring to FIGS. 1-6, the process 700 may be performed by a vaporizer device such as, for example, the vaporizer 100.

At block 710, the sensors 113 at the vaporizer 100 may detect an inhalation at the mouthpiece 130 of the cartridge 120 coupled to the reusable vaporizer body 110 of the vaporizer 100. For example, as noted, the vaporizer body 110 may include the inhalation sensor 280, which may be configured to detect an inhalation at the mouthpiece 130 of the cartridge 120 including by measuring an intensity of the inhalation.

At block 720, the controller 104 may activate, in response to the sensor 113 detecting the inhalation, the movable block 224 and the heater plate 221 such that the vaporizable material ejected from the cartridge 120 by the motion of the movable block 224 may be vaporized by the heater plate 221 to generate an aerosol. For example, in response to the inhalation sensor 280 detecting an inhalation (or an inhalation having an above-threshold intensity), the controller 104 may be configured to activate the battery 260 to deliver electrical power to the heater plate 221. Moreover, the controller 104 may respond to detecting the inhalation by activating the piezo stacks 250 such that motion (e.g., expansion and/or contraction) of the piezo stacks 250 may move the movable block 224 to cause a compression of the fluid channel 225 disposed between the movable block 224 and the first non-movable block 223. Compression of the fluid channel 225 may further cause one or more droplets of the vaporizable material to be ejected from the fluid channel 225 and travel, along the path 201, to the heater plate 221. The heater plate 221 may heat the droplets of the vaporizable material to a temperature that is sufficient to cause the vaporization of the vaporizable material ejected from the fluid channel 225 and generate an aerosol.

In some implementations of the current subject matter, the controller 104 may activate the movable block 224 and/or the heater plate 221 when the intensity of the inhalation measured by the inhalation sensor 280 exceeds a threshold value indicative of an intent to puff or inhale an amount of the vaporizable material. Moreover, the controller 104 may activate the heater plate 221 further in response to the electrode pair 222 (or a different type of sensor) detecting a successful ejection of one or more droplets of the vaporizable material from the fluid channel 225.

At block 730, at least a portion of the aerosol may be provided to a user. For example, at least a portion of the aerosol generated by the vaporization of the vaporizable material may be delivered to the user via the aerosol path 232, which may traverse at least a portion of the mouthpiece 130 of the cartridge 120.

Terminology

When a feature or element is herein referred to as being "on" another feature or element, it can be directly on the other feature or element or intervening features and/or elements may also be present. In contrast, when a feature or element is referred to as being "directly on" another feature or element, there are no intervening features or elements present. It will also be understood that, when a feature or element is referred to as being "connected", "attached" or "coupled" to another feature or element, it can be directly connected, attached or coupled to the other feature or element or intervening features or elements may be present. In contrast, when a feature or element is referred to as being "directly connected", "directly attached" or "directly coupled" to another feature or element, there are no intervening features or elements present.

Although described or shown with respect to one embodiment, the features and elements so described or shown can apply to other embodiments. It will also be appreciated by those of skill in the art that references to a structure or feature that is disposed "adjacent" another feature may have portions that overlap or underlie the adjacent feature.

Terminology used herein is for the purpose of describing particular embodiments and implementations only and is not intended to be limiting. For example, as used herein, the singular forms "a", "an" and "the" are intended to include the plural forms as well, unless the context clearly indicates otherwise. It will be further understood that the terms "comprises" and/or "comprising," when used in this specification, specify the presence of stated features, steps, operations, elements, and/or components, but do not preclude the presence or addition of one or more other features, steps, operations, elements, components, and/or groups thereof. As used herein, the term "and/or" includes any and all combinations of one or more of the associated listed items and may be abbreviated as "/".

In the descriptions above and in the claims, phrases such as "at least one of" or "one or more of" may occur followed by a conjunctive list of elements or features. The term "and/or" may also occur in a list of two or more elements or features. Unless otherwise implicitly or explicitly contradicted by the context in which it used, such a phrase is intended to mean any of the listed elements or features individually or any of the recited elements or features in combination with any of the other recited elements or features. For example, the phrases "at least one of A and B;" "one or more of A and B;" and "A and/or B" are each intended to mean "A alone, B alone, or A and B together." A similar interpretation is also intended for lists including three or more items. For example, the phrases "at least one of A, B, and C;" "one or more of A, B, and C;" and "A, B, and/or C" are each intended to mean "A alone, B alone, C alone, A and B together, A and C together, B and C together, or A and B and C together." Use of the term "based on," above and in the claims is intended to mean, "based at least in part on," such that an unrecited feature or element is also permissible.

Spatially relative terms, such as "forward", "rearward", "under", "below", "lower", "over", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if a device in the figures is inverted, elements described as "under" or "beneath" other elements or features would then be oriented "over" the other elements or features. Thus, the exemplary term "under" can encompass both an orientation of over and under. The device may be otherwise oriented (rotated 90 degrees or at other orientations) and the spatially relative descriptors used herein interpreted accordingly. Similarly, the terms "upwardly", "downwardly", "vertical", "horizontal" and the like are used herein for the purpose of explanation only unless specifically indicated otherwise.

Although the terms "first" and "second" may be used herein to describe various features/elements (including steps), these features/elements should not be limited by these terms, unless the context indicates otherwise. These terms may be used to distinguish one feature/element from another feature/element. Thus, a first feature/element discussed below could be termed a second feature/element, and similarly, a second feature/element discussed below could be termed a first feature/element without departing from the teachings provided herein.

As used herein in the specification and claims, including as used in the examples and unless otherwise expressly specified, all numbers may be read as if prefaced by the word "about" or "approximately," even if the term does not expressly appear. The phrase "about" or "approximately" may be used when describing magnitude and/or position to indicate that the value and/or position described is within a reasonable expected range of values and/or positions. For example, a numeric value may have a value that is +/−0.1% of the stated value (or range of values), +/−1% of the stated value (or range of values), +/−2% of the stated value (or range of values), +/−5% of the stated value (or range of values), +/−10% of the stated value (or range of values), etc. Any numerical values given herein should also be understood to include about or approximately that value, unless the context indicates otherwise. For example, if the value "10" is disclosed, then "about 10" is also disclosed. Any numerical range recited herein is intended to include all sub-ranges subsumed therein. It is also understood that when a value is disclosed that "less than or equal to" the value, "greater than or equal to the value" and possible ranges between values are also disclosed, as appropriately understood by the skilled artisan. For example, if the value "X" is disclosed the "less than or equal to X" as well as "greater than or equal to X" (e.g., where X is a numerical value) is also disclosed. It is also understood that the throughout the application, data is provided in a number of different formats, and that this data, represents endpoints and starting points, and ranges for any combination of the data points. For example, if a particular data point "10" and a particular data point "15" are disclosed, it is understood that greater than, greater than or equal to, less than, less than or equal to, and equal to 10 and 15 are considered disclosed as well as between 10 and 15. It is also understood that each unit between two particular units are also disclosed. For example, if 10 and 15 are disclosed, then 11, 12, 13, and 14 are also disclosed.

Although various illustrative embodiments are described above, any of a number of changes may be made to various embodiments without departing from the teachings herein. For example, the order in which various described method steps are performed may often be changed in alternative embodiments, and in other alternative embodiments, one or more method steps may be skipped altogether. Optional features of various device and system embodiments may be included in some embodiments and not in others. Therefore, the foregoing description is provided primarily for exemplary purposes and should not be interpreted to limit the scope of the claims.

One or more aspects or features of the subject matter described herein can be realized in digital electronic circuitry, integrated circuitry, specially designed application specific integrated circuits (ASICs), field programmable gate arrays (FPGAs) computer hardware, firmware, software, and/or combinations thereof. These various aspects or features can include implementation in one or more computer programs that are executable and/or interpretable on a programmable system including at least one programmable processor, which can be special or general purpose, coupled to receive data and instructions from, and to transmit data and instructions to, a storage system, at least one input device, and at least one output device. The programmable system or computing system may include clients and servers. A client and server are generally remote from each other and typically interact through a communication network. The relationship of client and server arises by virtue of computer programs running on the respective computers and having a client-server relationship to each other.

These computer programs, which can also be referred to programs, software, software applications, applications, components, or code, include machine instructions for a programmable processor, and can be implemented in a high-level procedural language, an object-oriented programming language, a functional programming language, a logical programming language, and/or in assembly/machine language. As used herein, the term "machine-readable medium" refers to any computer program product, apparatus and/or device, such as for example magnetic discs, optical disks, memory, and Programmable Logic Devices (PLDs), used to provide machine instructions and/or data to a programmable processor, including a machine-readable medium that receives machine instructions as a machine-readable signal. The term "machine-readable signal" refers to any signal used to provide machine instructions and/or data to a programmable processor. The machine-readable medium can store such machine instructions non-transitorily, such as for example as would a non-transient solid-state memory or a magnetic hard drive or any equivalent storage medium. The machine-readable medium can alternatively or additionally store such machine instructions in a transient manner, such as for example, as would a processor cache or other random access memory associated with one or more physical processor cores.

The examples and illustrations included herein show, by way of illustration and not of limitation, specific embodiments in which the subject matter may be practiced. As mentioned, other embodiments may be utilized and derived there from, such that structural and logical substitutions and changes may be made without departing from the scope of this disclosure. Such embodiments of the inventive subject matter may be referred to herein individually or collectively by the term "invention" merely for convenience and without intending to voluntarily limit the scope of this application to any single invention or inventive concept, if more than one is, in fact, disclosed. Thus, although specific embodiments have been illustrated and described herein, any arrangement calculated to achieve the same purpose may be substituted for the specific embodiments shown. This disclosure is intended to cover any and all adaptations or variations of various embodiments. Combinations of the above embodiments, and other embodiments not specifically described herein, will be apparent to those of skill in the art upon reviewing the above description.

What is claimed is:

1. A vaporizer device, comprising:

a vaporizer body including a receptacle disposed at a proximal end of the body, the receptacle configured to receive a cartridge while the cartridge is coupled with the vaporizer body, the cartridge including a reservoir holding a vaporizable material, and the cartridge further including a channel extending from the reservoir and having an opening at an end of the channel, a movable block, a controller configured to actuate the movable block, the actuating moving the movable block towards the channel to compress the channel, and the compression of the channel ejecting, from the opening at the end of the channel, at least a portion of the vaporizable material included in the reservoir, a heating element configured to vaporize the vaporizable material ejected from the opening of the channel, and a pair of electrodes positioned between the end of the channel and the heating element, wherein the pair of electrodes are configured to detect at least the portion of the vaporizable material being ejected from the opening of the channel, and wherein the heating element is activated to vaporize the vaporizable material in response to the pair of electrodes detecting at least the portion of the vaporizable material being ejected from the opening of the channel.

2. The vaporizer device of claim 1, wherein the channel is positioned proximate to the movable block when the cartridge is coupled with the vaporizer body.

3. The vaporizer device of claim 1, wherein the heating element is positioned towards the opening of the channel when the cartridge is coupled with the vaporizer body.

4. The vaporizer device of claim 1, wherein the cartridge further comprises a flow restrictor positioned at an inlet of the channel, and wherein the flow restrictor is configured to prevent the vaporizable material in the channel from flowing back into the reservoir.

5. The vaporizer device of claim 1, wherein the vaporizer body further comprises a sensor configured to measure an intensity of an inhalation on a mouthpiece of the cartridge, and wherein the controller is further configured to actuate the movable block based on the intensity of the inhalation.

6. The vaporizer device of claim 1, wherein the vaporizer body further comprises a piezo stack coupled to the movable block, and wherein the controller actuates the movable block by at least actuating the piezo stack.

7. The vaporizer device of claim 1, wherein the cartridge further comprises a venting hole configured to reduce a negative pressure in a portion of the reservoir.

8. The vaporizer device of claim 1, wherein the cartridge further comprises a hydrophobic membrane configured to attract one or more bubble that form within the vaporizable material in the reservoir.

9. The vaporizer device of claim 1, wherein the vaporizer body further comprises a power source, and wherein the power source includes a battery configured to provide power to the heating element.

10. The vaporizer device of claim 1, wherein the cartridge further comprises a filter positioned at an inlet of the channel, and wherein the filter is configured to prevent one or more air bubbles from entering the channel.

11. The vaporizer device of claim 1, wherein the channel is formed from a ceramic, a plastic material, and/or a metal.

12. The vaporizer device of claim 1, wherein an inner wall of the channel is formed from a hydrophobic material and/or includes a hydrophobic coating.

13. The vaporizer device of claim 1, wherein the heating element is detachable from the vaporizer body.

14. The vaporizer device of claim 1, wherein the heating element comprises one or more electrical contact pads.

15. The vaporizer device of claim 1, wherein one or more surfaces of the heating element are roughened in a microscale and/or a nanoscale.

16. The vaporizer device of claim 1, wherein the channel is positioned between a non-movable block and the movable block when the cartridge is coupled with the vaporizer body.

17. The vaporizer device of claim 1, wherein one or more surfaces of the heating element are treated with a hydrophilic treatment and/or a hydrophilic coating.

18. The vaporizer of device of claim 1, wherein the heating element comprises a thermistor fabricated on a diaphragm, and wherein the diaphragm is bonded to a substrate to form a hermetic chamber.

19. The vaporizer device of claim 18, wherein the heating element comprises a passivation layer disposed on a surface of the heating element, and wherein the passivation layer configured to isolate the heating element and the thermistor from the vaporizable material.

20. A vaporizer device, comprising:

a vaporizer body including a receptacle disposed at a proximal end of the body, the receptacle configured to receive a cartridge while the cartridge is coupled with the vaporizer body, the cartridge including a reservoir holding a vaporizable material, and the cartridge further including a channel extending from the reservoir and having an opening at an end of the channel, a movable block, a controller configured to actuate the movable block, the actuating moving the movable block towards the channel to compress the channel, and the compression of the channel ejecting, from the opening at the end of the channel, at least a portion of the vaporizable material included in the reservoir, and a heating element configured to vaporize the vaporizable material ejected from the opening of the channel, wherein the heating element comprises a thermistor fabricated on a diaphragm, and wherein the diaphragm is bonded to a substrate to form a hermetic chamber.

21. The vaporizer device of claim 20, wherein the heating element comprises a passivation layer disposed on a surface of the heating element, and wherein the passivation layer configured to isolate the heating element and the thermistor from the vaporizable material.

* * * * *